US005232130A

United States Patent [19]

Woodard

[11] Patent Number: 5,232,130

[45] Date of Patent: Aug. 3, 1993

[54] SHAKER PUZZLE

[76] Inventor: Robert W. Woodard, c/o Bio-Environmental Modifiers, R.R. #2, Box 94, Frankfort, Kans. 66427

[21] Appl. No.: 843,743

[22] Filed: Feb. 28, 1992

[51] Int. Cl.[5] ..... B67D 5/60

[52] U.S. Cl. ..... 222/464; 222/78; 221/288; 273/144 A

[58] Field of Search ..... 222/454, 456, 464, 78; 221/288; 273/113, 144 R, 144 A

[56] References Cited

U.S. PATENT DOCUMENTS

| | | | |
|---|---|---|---|
| 534,154 | 2/1895 | Hooper | 222/456 |
| 914,655 | 3/1909 | Glenn | 273/144 A |
| 1,516,913 | 11/1924 | Goldback . | |
| 1,980,061 | 11/1934 | Jackson | 222/456 |
| 2,423,784 | 7/1947 | Mackey | 222/456 |
| 2,425,142 | 8/1947 | Brubaker | 222/456 |
| 3,276,778 | 10/1966 | Luchsinger . | |
| 3,398,857 | 8/1968 | Alio | 221/288 X |
| 3,980,210 | 9/1976 | Klingerman | 222/456 |
| 4,424,921 | 1/1984 | Fenerstein et al. | 222/456 |
| 4,534,559 | 8/1985 | Laursen, Jr. . | |

*Primary Examiner*—Gregory L. Huson
*Attorney, Agent, or Firm*—Biebel & French

[57] ABSTRACT

A device is disclosed for dispensing food particles at a controlled rate in which a container is used having an aperture located on one side of the container. A tube is attached to the aperture such that food can pass through the tube, then through the aperture and be expelled outside the container. The aperture defines a longitudinal axis coinciding with the axis of the tube. The gap between the tube and an end portion of the device is predetermined to control the rate of consumption of the food particles being expelled from the container.

9 Claims, 7 Drawing Sheets 10
20
12
18

10
16
12
18
28
22
20
24
26
14
21

10
3
26
14
3

10
12
14
16
18
20
21
24
26
30
32

SHAKER PUZZLE

BACKGROUND OF THE INVENTION

This invention relates to a device for dispensing food particles, and more specifically to a container for dispensing food particles at a controlled rate, thereby providing a challenge in removing the food particles as well as prolonging the consumption time of the food particles placed in the container.

SUMMARY OF THE INVENTION

The present invention is a device for dispensing food particles at a controlled rate. The device is a container which has a tube located inside the container to control the dispensing of the food particles from the container. The container has opposing walls which define an interior with one of the opposing walls defining an aperture with a predetermined circumference. The aperture defines a longitudinal axis which extends through the interior of the container.

The tube has opposing ends and a center axis with one of the ends of the tube attached to the container at the aperture thereof. The tube is oriented relative to the aperture such that the center axis of the tube coincides with the longitudinal axis of the aperture. The inner diameter of the tube has a predetermined dimension. The other end of the tube opens into the interior of the container towards the opposing wall, which wall is located in close proximity to the open tube end.

The location of the tube inside the container is strategically selected such that only a few food particles can be dispensed at a time when the container is turned upside down. In addition, the food dispensing device is preferably provided with a container having a shape related to the particular environment in which the container is used. For example, a cylinder shape may be provided for feeding primates whereas a "jack-o-latern", Christmas tree or other shape may be provided, depending on the season, for dispensing candy to children.

Therefore it is an object of the present invention to provide a device which dispenses food particles at a controlled rate, so that a person or animal using the device will extend the time in which the food particles are consumed.

It is another object of the present invention to provide a device for dispensing food particles which limits the consumption of food by limiting the amount of food particles which a person or animal can access during a given time period.

It is another object of the present invention to provide a device for dispensing food particles which can be refilled and used more than once.

It is yet another object of the present invention to provide a device for dispensing food particles which is inexpensive to manufacture and which has equal utility for use by humans and animals.

It is an additional object of the invention to provide a puzzle which may be used to dispense candy and which provides a fun challenge to children attempting to remove candy from the puzzle.

Furthermore, it is an object of the present invention to provide a device for dispensing food particles which can take several shapes, thereby accommodating for a particular season in which the device is sold and thus increasing the utility of the device in providing an attractive food dispensing device customized for a particular seasonal application.

Other objects and advantages of the present invention will be apparent from the following description, the accompanying drawings and the appended claims.

DETAILED DESCRIPTION OF THE PREFERRED EMBODIMENT

Figure 1:
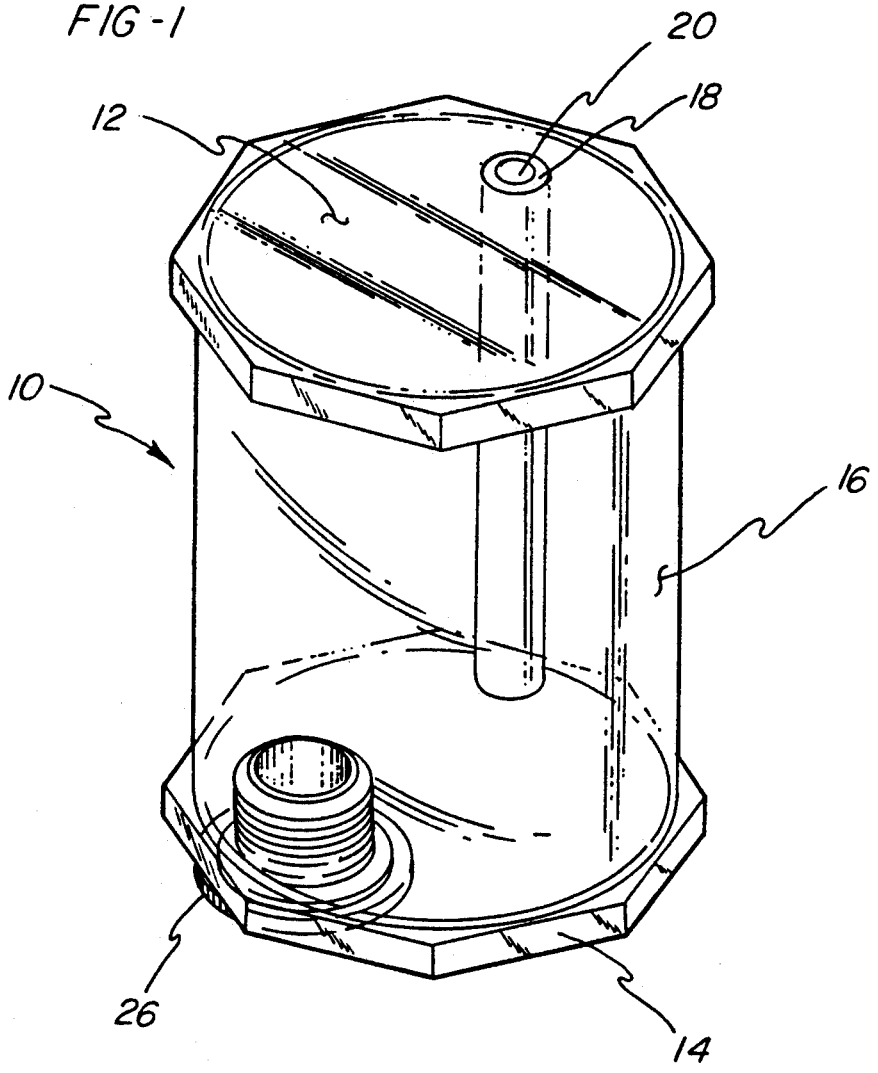
FIG. 1 is a perspective view of the device for dispensing food particles.

Referring to FIG. 1, the device of the present invention is shown in the shape of a cylinder. This device is particularly adapted for use when it is desired to limit the rate at which food particles can be extracted. An example of the use of this device would be for the feeding of animals, such as a monkey or other primate, in which the rate of consumption of food particles must be controlled, thereby maintaining an appropriate diet. For instance, the device may be used to control the dispensing of cereals, nuts or sunflower seeds.

Another example of the use of this device would be for a person who is dieting and who enjoys snacking. By placing a predetermined amount of food particles in the container for the person to snack on, the device may be used to limit the rate in which the person consumes the food particles, which will lessen the number of food particles consumed over a period of time and limit the intake of calories.

Referring to FIGS. 1–4, the device for dispensing food particles comprises a container 10 having a side wall portion 16, a bottom wall 14 and a top wall 12. The container preferably has a cylindrical shape as shown in the figures, but can have other shapes which will be discussed further below. The top wall 12, bottom wall 14 and side wall portion 16 define an interior 22 for the container 10. The top wall 12 defines an aperture 18 having a predetermined diameter, and the aperture 18 defines a longitudinal axis 28 which extends into the interior 22 of the container 10, parallel to the side wall portion 16 and perpendicular to the top and bottom walls 12, 14.

Figures 2, 3, 4:
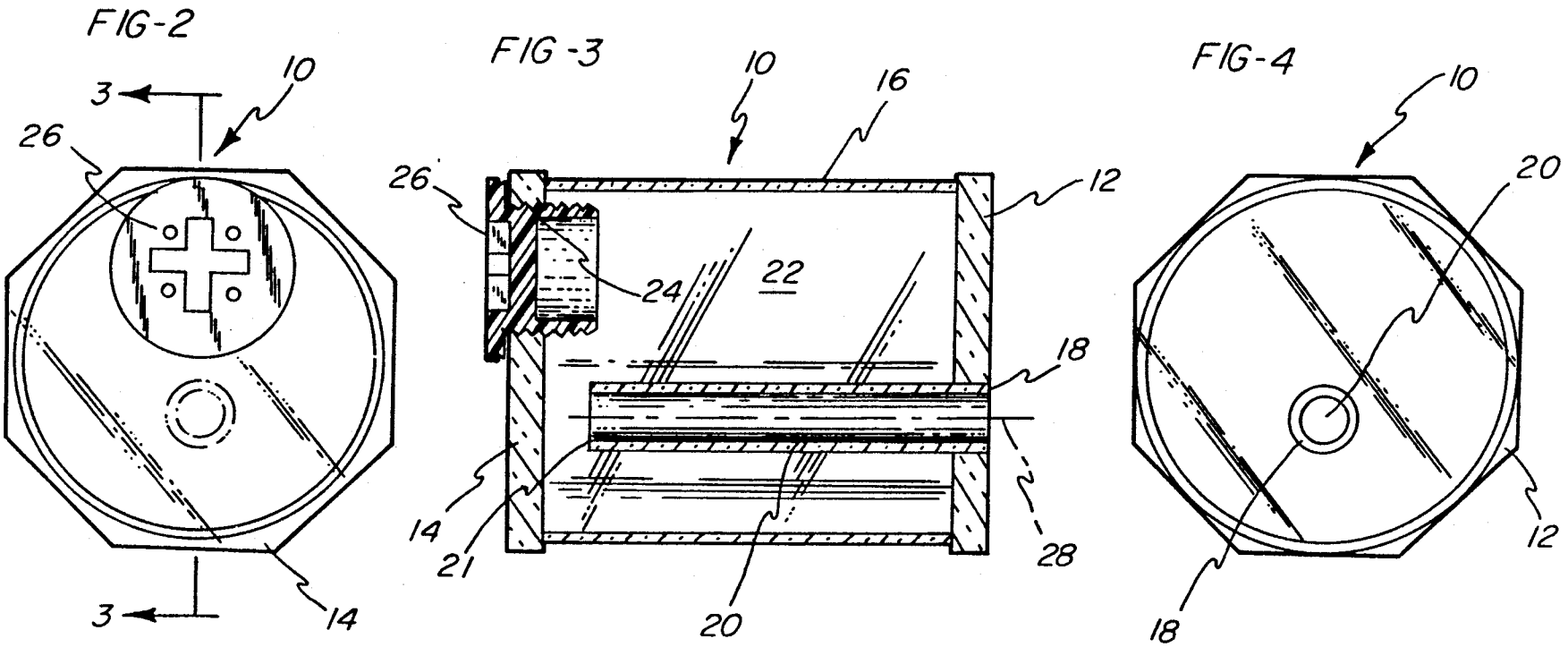
FIG. 2 is a bottom view of the device for dispensing food particles.
FIG. 3 is a side cross-sectional view of the device for dispensing food particles.
FIG. 4 is a top view of the device for dispensing food particles.

Referring specifically to FIGS. 3 and 4, a tube 20 is provided attached to the top wall 12 of the container 10. The tube 20 has a center axis which coincides with the longitudinal axis 28 of the aperture 18. Preferably, the tube has an outer diameter equal to the inner diameter of the aperture 18, so that the tube 20 can be attached to the inside of the aperture 18 as shown in FIG. 3.

The tube 20 extends into the interior 22 of the container 10 and includes an end 21 opposite from the end of the tube engaged with the aperture 18, wherein the end 21 is located adjacent to and spaced from the bottom wall 14 a predetermined distance. The distance from the end 21 of the tube 20 to the bottom wall 14 is determined by the level of difficulty desired for removing food from the puzzle as well as by the size of the food particles to be used. Further, in the preferred embodiment, the distance from the tube end 21 to the wall 14 is typically less than the diameter of the aperture defined by the inner wall surface of the tube 20.

The inner diameter of tube 20 and the distance from the end 21 of tube 20 to the bottom wall 14 is dependent upon the size of the food particles which will be placed in the interior 22 of the container 10. Generally, the inner diameter of tube 20 and the distance from the end 21 of the tube 20 to the bottom wall 14 will be less than twice the size of the food particles but greater than the size of food particles located inside the container 10. This is important so that the food particles can freely move between the end 21 of tube 20 and the bottom wall 14, and can freely move through tube 20. Further, this construction ensures that the food particles will be located in close proximity to the open end 21 as they move between the end 21 and the bottom wall 14 such that they will be likely to pass into the tube 20 through the end 21.

Further, it should be noted that the bottom wall 14 defines a support surface for supporting food particles in alignment with the longitudinal axis 28 and open end 21 of the tube 20, and in order to facilitate sideways movement of the food particles along the support surface in the area of the tube end 21, a particle movement space is provided surrounding the longitudinal axis 28. The particle movement space is defined by an unobstructed area surrounding the longitudinal axis 28 from the tube end 21 to a point adjacent to the support surface at the bottom wall 14 and encompasses an area having a diameter greater than the outer diameter of the tube 20. Thus, as the container 10 is inverted, the food particles will be free to slide out of alignment with the longitudinal axis 28 of the tube 20 and fall toward the top wall 12 outside of the tube 20, while other food particles may randomly align with the tube end 21 and pass out of the container through the tube 20.

Referring to FIGS. 2 and 3, a fill aperture 24 is shown in the bottom wall 14 of the container 10. This fill aperture has a diameter which is large enough to allow food particles to pass through the aperture 24 into the interior 22 of the container 10 for filling of the container. A plug 26 is provided to close the fill aperture 24 thereby maintaining the food particles inside the interior 22 of container 10. This plug 26 can either be screwed or pressed into aperture 24 and has an outer diameter or dimension that is sufficient to close aperture 24.

It should be noted at this time that the fill aperture 24 and plug 26 are optional. During the initial production of the container 10, the food particles can be placed inside the container 10 before the top 12 or bottom 14 walls are permanently attached to the side walls 16. In such an embodiment, the container 10 may be made of a disposable material, such as paper or plastic, which may be discarded once all the food particles inside the container 10 are consumed. This type of disposable device is particularly desirable and can be used for containing and selling candy to children since the device will prevent the candy from being consumed all at once.

Figures 5A, 5B, 5C:
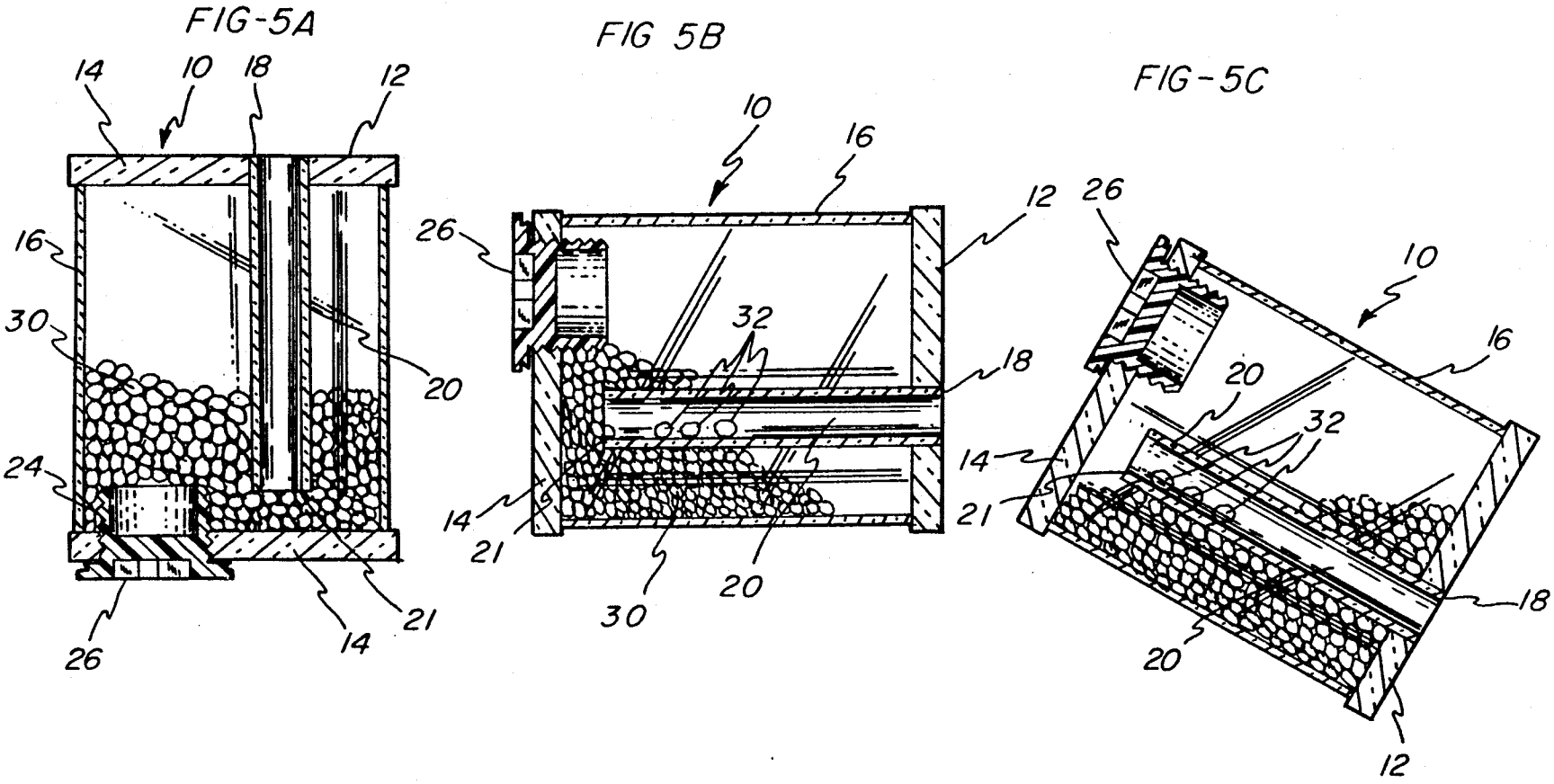
FIGS. 5A–5C show a sequence of movements for tipping food out.

Now referring to FIGS. 5A-5C, the container 10 is shown filled with food particles 30 with the plug 26 closing the fill aperture 24 preventing the food particles 30 from exiting through fill aperture 24. In use, the container 10 is tilted sideways such that a few food particles 32 pass into the tube 20. As stated above, the inner diameter of tube 20 and the distance between the end of tube 20 and bottom wall 14 is selected such that the few food particles 32 can pass by the end 21, as well as enter tube 20. The container 10 is further rotated upside down such that gravity draws the select food particles 32 from the tube 20 through aperture 18 of the top wall 12. This rotation of the container 10 from right side up to upside down is continued until all of the food particles 30 are expelled from the inside 22 of container 10.

It should be noted at this time, that the decrease in food particles 30 inside the container 10 will increase the time in which it takes to expel the food particles 30 from the interior 22 of the container 10. In other words, the more food particles 30 that are removed from the container 10, the more difficult it is to align selected food particles 32 with the end 21 for passage into the tube 20. This is due to the non-changing characteristics of the container 10 such that the volume and the distance between the end of tube 20 and bottom wall 14 both remain constant, but the amount of food particles 30 located inside container 10 decreases as the food particles 30 are expelled from container 10. In other words, as the number of food particles 30 in the container 10 decreases, the number of particles surrounding the tube 20 will decrease resulting in a corresponding decrease in the probability that particles 30 will be aligned for entry into the end 21 of the tube 20. Therefore, it can be appreciated that the design of the device results in a controlled rate of consumption.

Figure 6A:
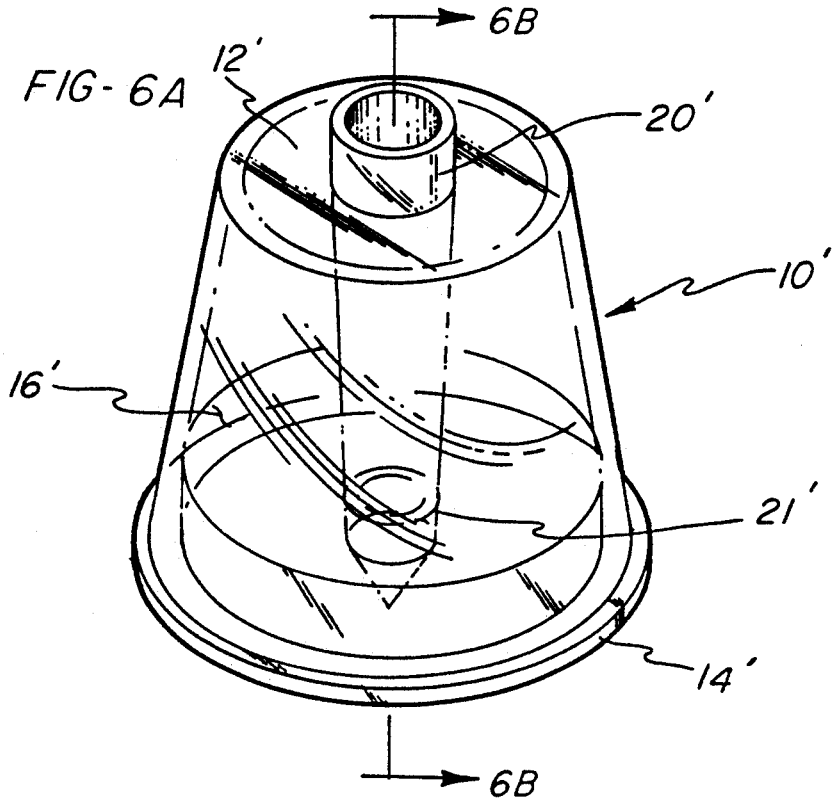
FIGS. 6A and 6B show an alternate embodiment of the device in the shape of a top.
Figure 6B:
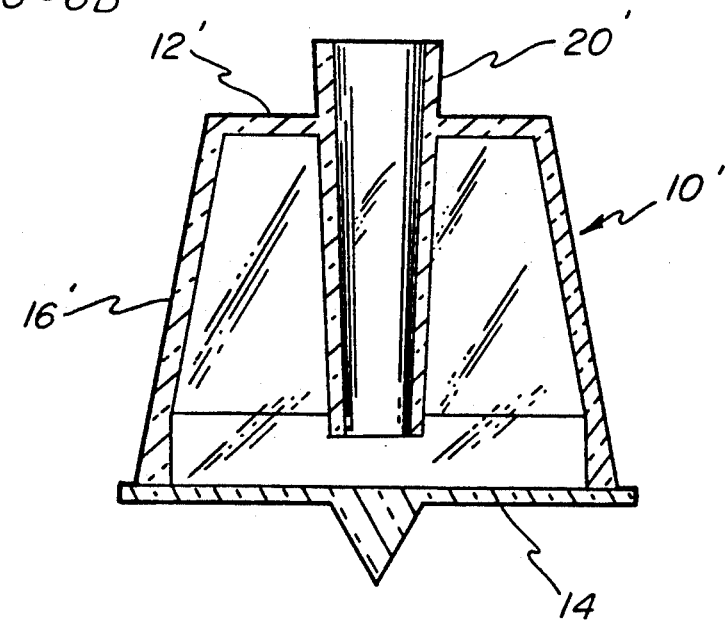

An alternate embodiment of the device for dispensing food particles at a controlled rate is shown in FIGS. 6A and 6B, in which the shape of container 10' is that of a spinning top and in which elements similar to the previous embodiment are identified with the same numeral primed. This embodiment would preferably be used to contain candy, since a spinning top is generally attractive to children. The tube 20' is located in the center of the container 10' such that the center axis coincides with the longitudinal axis 28' of the aperture and the center axis of the tube 20'. thus, this device has additional utility as a toy after the container 10' is empty.

Figure 7A:
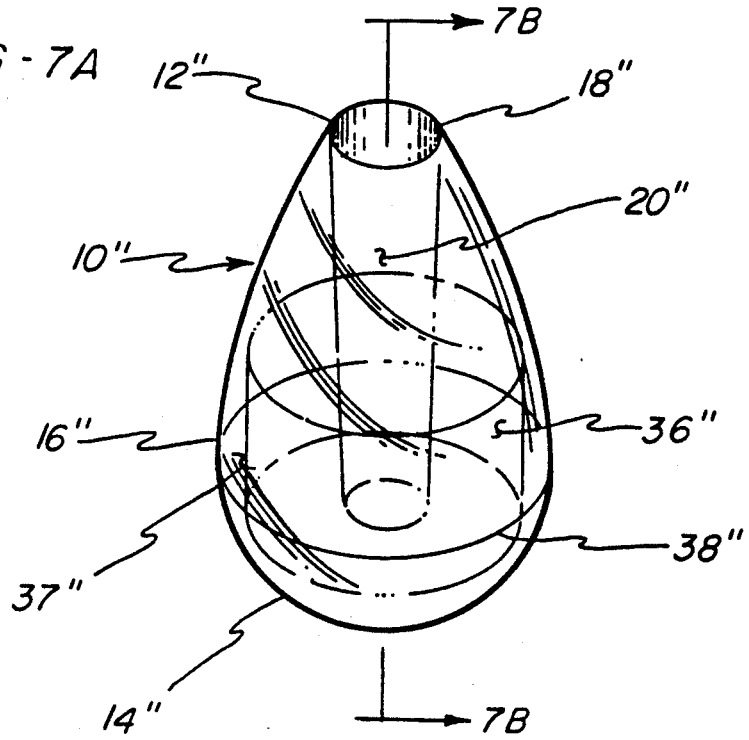
FIGS. 7A and 7B show another alternate embodiment of the device in the shape of an egg.
Figure 7B:
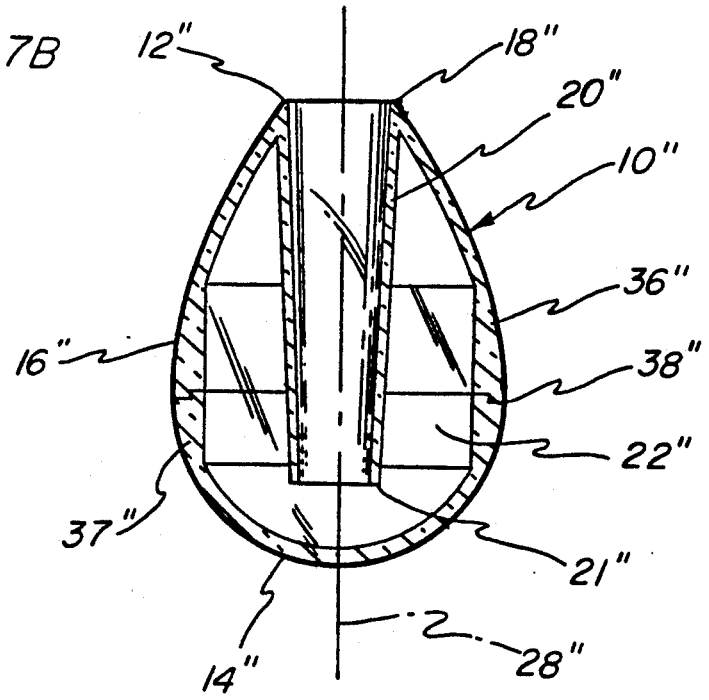

Another embodiment of the present invention is shown in FIGS. 7A and 7B in which the container 10" is shown in the shape of an egg and in which elements similar to the first embodiment are identified with the same reference numeral doubled primed. The egg shape of container 10" would be appropriate during the Easter season to place candies inside the container 10". In this embodiment, the top wall 12" is coterminous with the means defining the aperture 18" and the side wall portion 16" blends into the bottom wall 14". The tube 20" is attached to the aperture 18" such that the center axis of tube 20" coincides with the longitudinal axis 28" and the center axis of the container 10". This embodiment may be formed of opposing end portions 36", 37" joined at seam 38" such that it can be filled or, as stated above, can be permanently sealed during the production of container 10" once the container 10" is filled. Again, once all the candies are dispensed, the container 10'' may be discarded or kept as a toy.

Figure 8A:
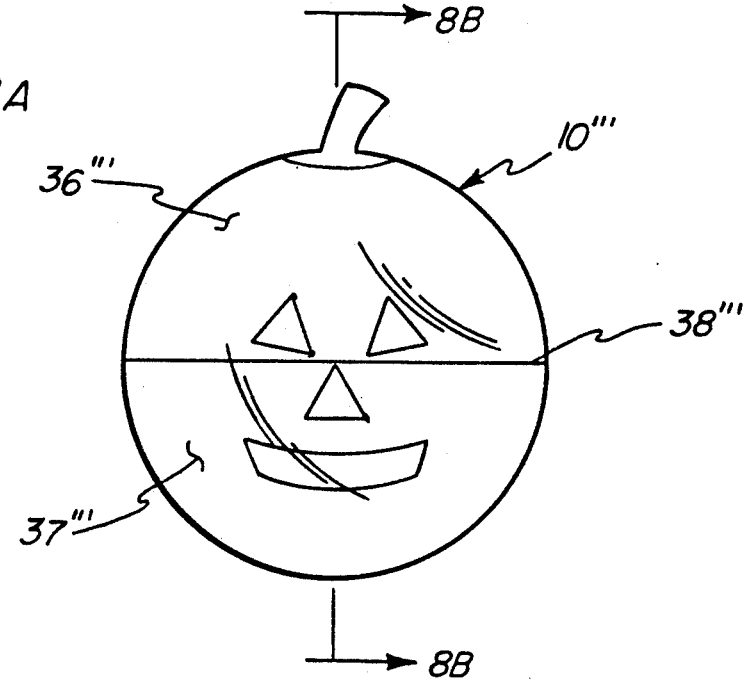
FIGS. 8A and 8B show a third alternate embodiment of the device in the shape of a sphere such as a pumpkin or jack-o-lantern.
Figure 8B:
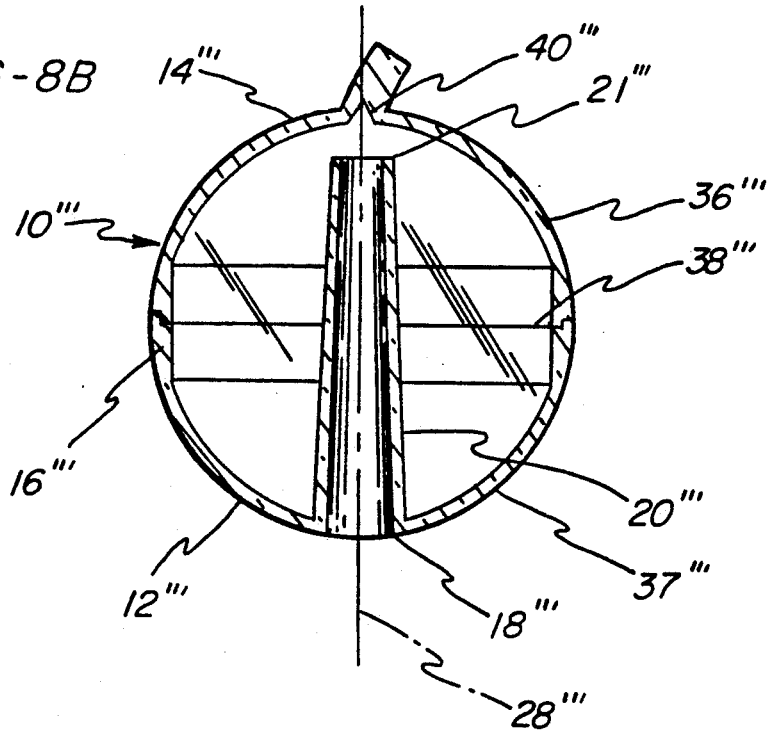

A third embodiment of the present invention is shown in FIGS. 8A and 8B wherein the container 10''' is shown in the shape of a sphere, and in which elements similar to the first embodiment are identical with the same numeral triple primed. In this embodiment, the top wall 12''', bottom wall 14''' and side wall portion 16''' are formed as segments of a circle defining the sphere. As shown, this shape can be that of a pumpkin or jack-o-lantern which is appropriate for the Halloween season. Again, the tube 20''' is attached to aperture 18''' such that the center axis of tube 20''' coincides with longitudinal axis 28''' and center axis of the container 10'''. Again, the container in this embodiment has opposing portions 36''', 37''', joined at seam 38''' for filling or refilling container 10'''. A notch 40'''is provided in the wall 14''' opposite from the tube end 21''' for entrapping food particles and thereby facilitating placement of the food particles into the tube 20''' when the container 10''' is tipped upside down.

Figure 9A:
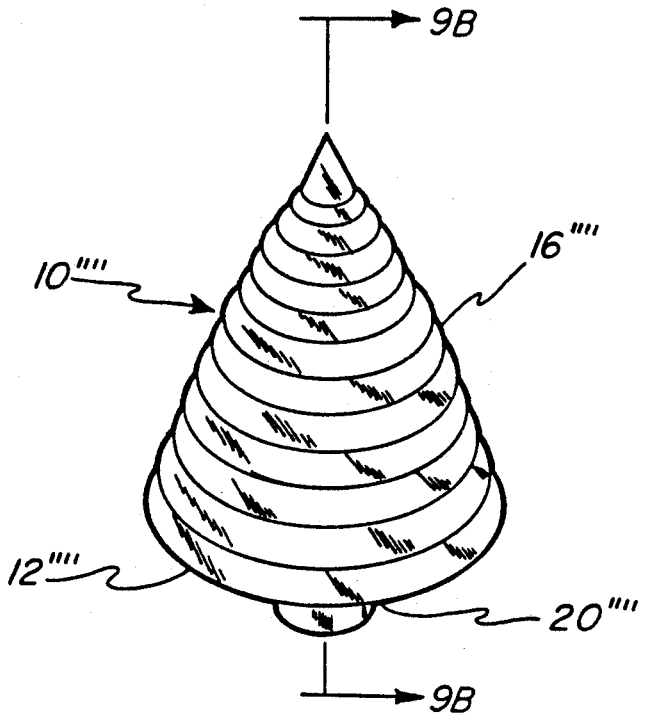
FIGS. 9A and 9B show a fourth alternate embodiment of the device in the shape of a tree.
Figure 9B:
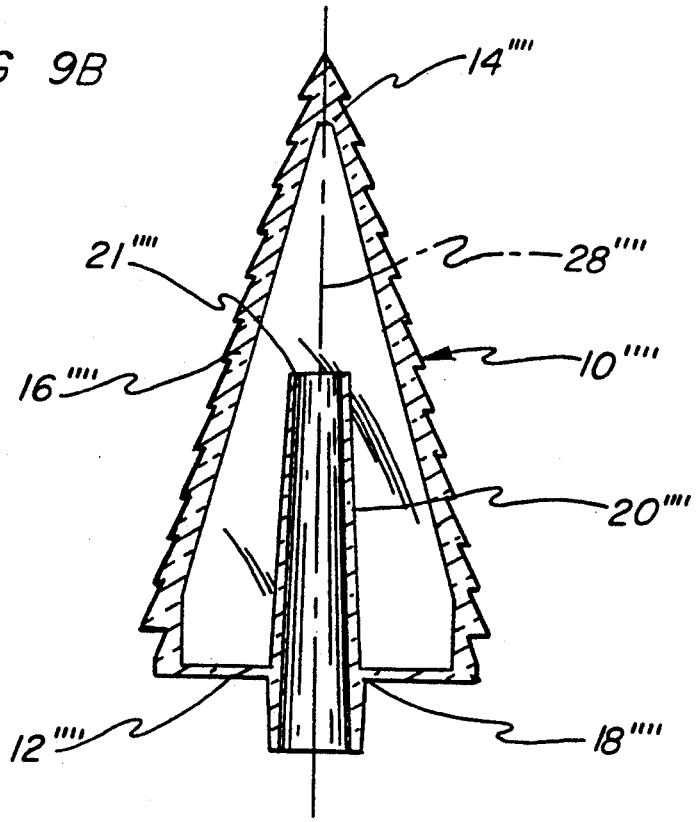

A fourth embodiment of the device for dispensing food particles is shown in FIG. 9 in which the shape of container 10'''' is that of a tree, and in which elements similar to the first embodiment are identified with the same numeral quadruple primed. The tube 20'''' is located in the aperture 18'''' and extends beyond the aperture in this embodiment. The side wall portion 16'''' has a conical shape, coinciding with a tree, having a top apex which is coterminous with the bottom wall 14''''. The center axis of the container 10'''' passes through the apex and coincides with longitudinal axis 28'''' and the center axis of the tube 20''''. The cone shape of this embodiment will facilitate the placement of food particles for the Christmas season in which candies can be placed inside the container 10''''.

It should be noted that in this embodiment the spacing between the side wall portion 16'''' and the tube end 21'''' is selected to ensure that food particles pass into the tube 20''''. For example, the spacing may be less than twice the diameter of the tube 20''''.

The embodiments of the device for dispensing food particles at a controlled rate can be used for various purposes as mentioned above for different seasons or for dietary control. Each device for dispensing food particles is structured such that the rate of consumption can be controlled, with this rate dependent upon the distance between the end of the tube and the bottom or opposing wall. The device can take several shapes as stated above in order to be attractive and used for particular seasons of the year. Furthermore, the device is particularly useful for controlling the rate of consumption for animals, such as primates, in which a limited amount of food is given to the primates in order to control their diets.

In addition, the present invention may be used as a candy puzzle which acts as a game for entertaining children wherein the puzzle provides a challenge as a child attempts to remove candy from the puzzle through the tube.

While the forms of the apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. A device for randomly dispensing food particles at a controlled rate, comprising:

a container having opposing first and second wall portions defining an interior, said first wall portion including means defining an aperture having a predetermined diameter;

a tube defining a longitudinal axis perpendicular to said first wall portion and having opposing first and second ends and predetermined inner and outer diameters, said first end of said tube being attached to said container at said aperture and said second end of said tube defining a tube opening positioned adjacent to and spaced from said second wall portion for randomly receiving food particles therethrough;

said second wall portion defining a support surface intersected by said longitudinal axis for supporting food particles in alignment with said tube opening; and a particle movement space surrounding said longitudinal axis and defined by an area having a diameter greater than said outer diameter of said tube and extending along said longitudinal axis from said tube end to a point adjacent to said support surface such that food particles supported by said support surface will be free to slide along said support surface away from said longitudinal axis and move toward said first wall portion outside of said tube when said device is inverted.

2. The device of claim 1 wherein said container is a sphere having a symmetrical shape defining a central longitudinal axis coinciding with said longitudinal axis of said tube.

3. The device of claim 1 wherein one of said opposing wall portions include means defining a fill aperture for filling said container with food particles and a plug is provided to close said fill aperture preventing said food particles from escaping said interior of said container through said fill aperture.

4. The device of claim 1 wherein said second end of said tube is spaced from said support surface a distance equal to or less than said predetermined inner diameter of said tube.

5. A device for randomly dispensing food particles at a controlled rate comprising:

a container having opposing substantially planar top and bottom sides and a side wall portion extending between said top and bottom sides to define an interior for said container, said top side of said container including means defining an aperture for said container having a predetermined diameter;

a tube defining a longitudinal axis perpendicular to said top side and located in spaced relation to said side wall portion and having a first end attached to said top side at said aperture, and said tube including a second end located in spaced relation to said side wall portion and defining a tube opening positioned a predetermined distance away from said bottom side for randomly receiving food particles therethrough;

said bottom side defining a support surface intersected by said longitudinal axis for supporting food particles in alignment with said tube opening; and a particle movement space surrounding said longitudinal axis and defined by an area having a diameter greater than an outer diameter of said tube and extending along said longitudinal axis from said tube end to a point adjacent to said support surface such that food particles supported by said support surface will be free to slide along said support surface away from said longitudinal axis and move toward said first wall portion outside of said tube when said device is inverted.

6. The device as in claim 5 wherein said container includes means defining a fill aperture and a plug is provided to close said fill aperture, said fill aperture providing a means to fill said container with food particles and said plug preventing the food particles from escaping from said container through said fill aperture.

7. The device as in claim 5 wherein said predetermined distance is equal to or less than an inner diameter of said tube.

8. The device of claim 5 wherein said container has a cylindrical shape with said top and bottom sides defining ends of said container and said side wall portion defining a circular side of said container.

9. The device of claim 1 including a side wall extending between said first and second wall portions to further define said interior for said device, wherein said outer diameter of said tube is spaced from said side wall.

* * * * *